US006319147B1

(12) United States Patent
Nakamura et al.

(10) Patent No.: US 6,319,147 B1
(45) Date of Patent: Nov. 20, 2001

(54) IRON GOLF CLUB SET

(75) Inventors: Yoshihide Nakamura; Shinya Ono, both of Tokyo; Tadashi Miura, Hiratsuka, all of (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 0 days.

(21) Appl. No.: 09/576,801

(22) Filed: May 23, 2000

(30) Foreign Application Priority Data

May 24, 1999 (JP) ..... 11-143447

(51) Int. Cl.[7] ..... A63B 53/00; A63B 55/00
(52) U.S. Cl. ..... 473/287; 473/289; 473/318
(58) Field of Search ..... 473/304–323, 473/287–291

(56) References Cited

U.S. PATENT DOCUMENTS 3,963,236 * 6/1976 Mann ..... 473/289
4,240,631 * 12/1980 MacDougall ..... 473/289
4,431,187 * 2/1984 Rumble et al. ..... 473/323
4,555,112 * 11/1985 Masghati ..... 473/289
4,563,007 * 1/1986 Bayliss et al. ..... 473/289
5,380,004 * 1/1995 Teramoto et al. ..... 473/291
5,685,781 * 11/1997 Pedersen ..... 473/318
5,820,480 * 10/1998 Cheng ..... 473/289
5,971,865 * 10/1999 Shenoha ..... 473/316

* cited by examiner

*Primary Examiner*—Jeanette Chapman
*Assistant Examiner*—Mitra Aryanpour
(74) *Attorney, Agent, or Firm*—Finnegan, Henderson, Farabow, Garrett & Dunner, L.L.P.

(57) ABSTRACT

Disclosed is an iron golf club set which comprises a plurality of golf clubs of different counts, each golf club having a steel shaft, wherein a steel shaft of a shorter golf club is set heavier than that of a longer golf club; a step formation region is provided in a position having an equal distance for all of the golf clubs from a grip end in a shaft axial direction, the step formation region having a shaft outer diameter changed in a plurality of steps therein; a specific area is set in a position having an equal distance for all of the golf clubs from a sole end of a head in the shaft axial direction, and is nearer to a grip with respect to a shaft full length in the step formation region of each golf club; and a step interval in the specific area is set narrower than that outside the specific area.

7 Claims, 2 Drawing Sheets

IRON GOLF CLUB SET

BACKGROUND OF THE INVENTION

The present invention relates to an iron golf club set composed of a plurality of golf clubs having steel shafts. More specifically, the present invention relates to an iron golf club set adapted to facilitate swinging for the entire club set, particularly realizing easy rising of a ball when it is hit by a longer golf club, and easy control of the direction of a ball when it is hit by a shorter golf club.

For a shaft of an iron golf club, a steel shaft having a steel pipe formed in a tapered shape has been used. As methods used to manufacture steel shafts corresponding to respective counts when an iron golf club set is made using such steel shafts, a stretching process, a chip-cutting process, and so on, have been available.

The stretching process is a method comprising the steps of preparing raw material pipes (base pipes) equal in weight for a plurality of golf clubs; and stretching the raw material pipes until they reach lengths corresponding to respective counts while forming step patterns (node-shaped patterns appearing in shaft axial directions) on outer circumferential surfaces of the raw material pipes by using a plurality of dies different in inner diameters. On the other hand, the chip-cutting process is a method comprising the steps of preparing a plurality of steel shafts stretched to a predetermined length while forming step patterns on outer circumferential surfaces of raw material pipes; and cutting the tip portions of these steel shafts corresponding to the lengths of respective counts such that the steel shafts can be formed to have necessary lengths. Each of the step patterns generally includes a plurality of steps formed at a predetermined interval along the shaft axial direction.

However, in the case of the stretching process, all the steel shafts in the golf club set are constant in mass, the shafts stretched relatively long for the long clubs are thin, and the shafts stretched relatively short for the short clubs are thick. Thus, the long club gives a heavy feeling to a golfer, while the short club gives a light feeling to the golfer. On the other hand, in the case of the chip-cutting process, the shafts for the short clubs are substantially lighter in mass.

If the long golf clubs were felt to be heavy in relative relation, then swinging for the long clubs became difficult, resulting in difficult rising of a ball. If the short golf clubs were felt to be light in relative relation, then controlling of a direction of a ball hit by the short golf club became difficult. As a result, the use of the iron golf club set composed of the plurality of golf clubs made of steel shafts was difficult for those other than professional golfers or highly skilled players.

SUMMARY OF THE INVENTION

An object of the present invention is to provide an iron golf club set adapted to facilitate swinging for all of the clubs in the set, particularly to realize easy rising of a ball when it is hit by a longer golf club, and to make it easy to control the direction of a ball when it is hit by a shorter golf club.

In order to achieve the foregoing object, an iron golf club set of the present invention comprises a plurality of golf clubs of different count, each golf club having a steel shaft, wherein a steel shaft of a shorter golf club is set heavier than that of a longer golf club; a step formation region is formed in a position spaced by a first axial distance from a grip end of a shaft, the first axial distance being equal for all of the golf clubs, the step formation region having differing shaft outer diameters in a plurality of steps therein; a specific area within the step formation region is set in a position spaced by a second axial distance from a sole end of a head in the shaft, the second axial distance being equal for all of the golf clubs, and the specific area is nearer to a grip with respect to a shaft full length of each golf club; and a step interval in the specific area is smaller than that outside the specific area.

By setting the steel shaft of the longer golf club lighter and that of the shorter golf club heavier as described above, swinging of the golf clubs can be facilitated for all of the club sets. In addition, since the specific area is set in the position having an equal distance for all of the golf clubs from the sole end of the head in the shaft axial direction and nearer to the grip with respect to the shaft full length in the step formation region of each golf club, a kick point of the longer golf club can be set in a middle position of the shaft (middle kick point), while a kick point of the shorter golf club can be set nearer to a hand side (high kick point). As a result, easy ball rising can be realized for the longer golf clubs, and easy control of a hit ball direction can be realized for the shorter golf clubs.

Preferably, weights of the steel shafts should be gradually increased from the longer golf club to the shorter golf club, and a weight difference between the steel shaft of the longest golf club and that of the shortest golf club in the club set should be set in a range of 2 to 20 g.

For the step formation region, preferably, a starting end thereof should be set in a range of 65 to 190 mm from the grip end, and a terminating end thereof should be set in a range of 601 to 726 mm from the grip end. On the other hand, for the specific area, preferably, a starting end thereof should be set in a range of 496 to 536 mm from the sole end, and a terminating end thereof should be set in a range of 376 to 416 mm from the sole end. By setting the step formation region and the specific area in the above ranges, a kick point of the longer golf club can be set in a middle position of the shaft (middle kick point), while a kick point of the shorter golf club can be set nearer to the hand side (high kick point).

A step interval in the specific area should preferably be set constant in a range of 20 to 40 mm. More specifically, a length of the specific area in the shaft axial direction should be set in a range of 80 to 160 mm, and the number of steps provided in the specific area should be set in a range of 2 to 4.

BRIEF DESCRIPTION OF THE DRAWINGS

For a more complete understanding of the present invention and the advantages thereof, reference is now made to the following description taken in conjunction with the accompanying drawings, in which.

DETAILED DESCRIPTION OF THE PREFERRED EMBODIMENTS

Figure 1:
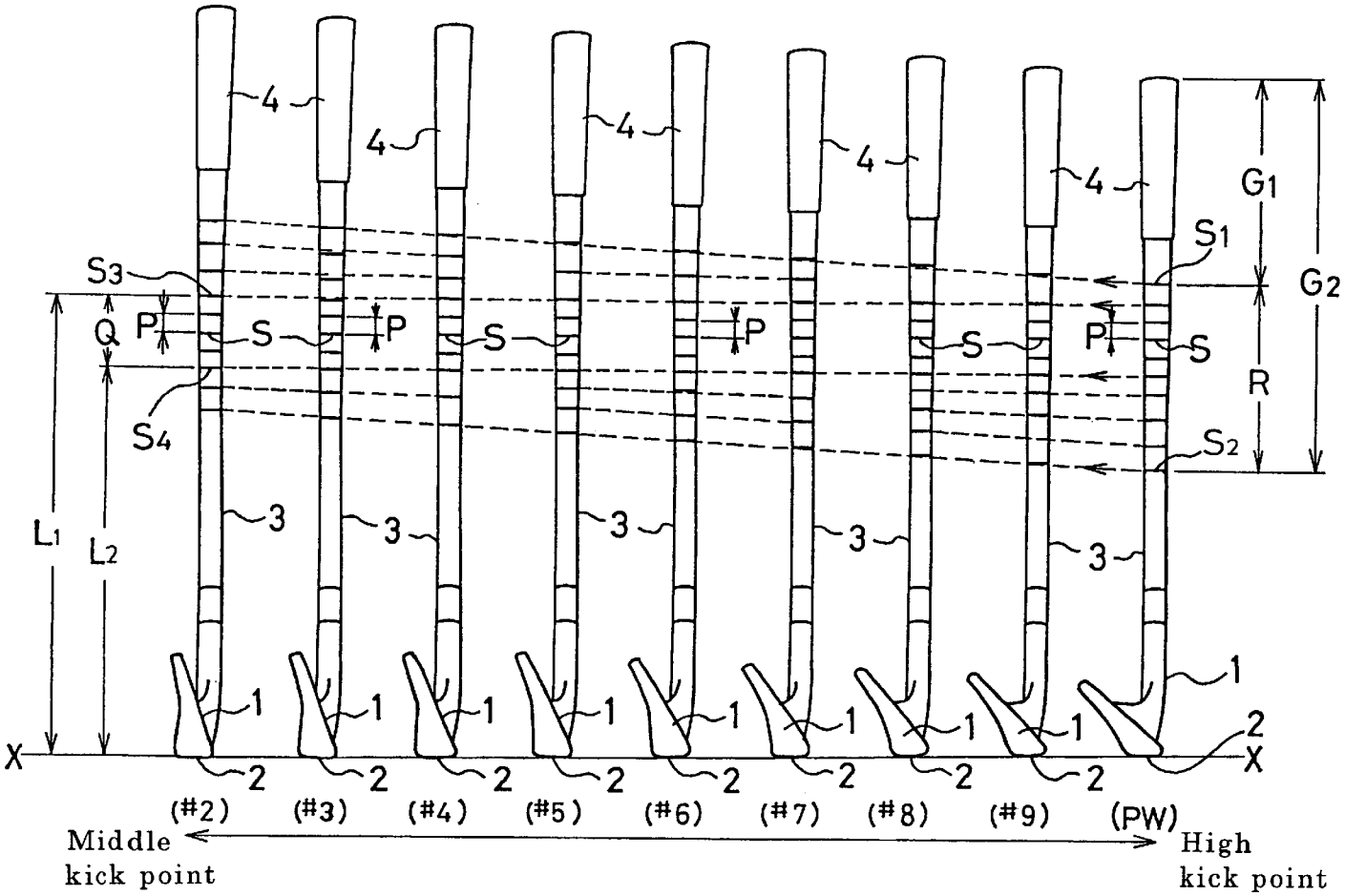
FIG. 1 is a front view showing an iron golf club set according to an embodiment of the present invention.

FIG. 1 illustrates an iron golf club set according to an embodiment of the present invention. This iron golf club set comprises long iron clubs (#2 to #4), middle iron clubs (#5 to #7) and short iron clubs (#8, #9 and PW). These golf clubs are set in such a manner that as counts are larger, club lengths made to be shorter and loft angles are made to be larger. In this embodiment, one set is composed of totally nine iron golf clubs, but there should be no particular limitation placed on the number of golf clubs constituting a set. Instead of the pitching wedge (PW), an approaching wedge (AW) or sand wedge (SW) may be used.

In addition, in this embodiment, reference is made to the clubs #2 to #4 as long iron clubs, the clubs #5 to #7 as middle iron clubs, and the clubs #8, #9 and PW as short iron clubs. But this is only a general combination, and a combination should not limited to such.

Each golf club constituting the above iron golf club set is constructed by fixing a head 1 to a tip end portion in the tip side of a steel shaft 3, and fixing a grip 4 to a rear end portion of its butt side. FIG. 1 shows a state where a sole face 2 of the hevad 1 is placed on a horizontal surface X—X, and the steel shaft 3 is erected in a vertical manner.

The steel shaft 3 of each golf club is made by the foregoing stretching process. Specifically, the steel shafts 3 were made by preparing raw material pipes (base pipes) different in weight for a plurality of golf clubs, and stretching the raw material pipes until they reached lengths corresponding to respective counts while forming step patterns on the outer circumferential surfaces of the raw material pipes using a plurality of dies different in inner diameters. As a result, a plurality of steps S were formed on the outer circumferential surface of each steel shafts 3, and a shaft outer diameter varies depending on such steps S.

In this embodiment, weight of the steel shafts 3 is set in such a way as to be gradually increased from the long golf clubs (#2 to #4) toward the short golf clubs (#8, #9 and PW). The weight of the steel shafts 3 may be continuously changed from the long golf clubs to the short golf clubs. Alternatively, for example, the golf clubs may be divided into long, middle and short groups, and the weight of the steel shafts may be changed in stages from group to group.

A difference in weight between the steel shaft of the longest golf club (#2) and that of the shortest golf club (PW) is set in a range of 2 to 10 g. If the weight difference between the steel shafts 3 is less than 2 g, then an effect obtained based on the weight difference becomes insufficient and, considering manufacturing tolerance, there is a possibility that the relation of the weights of the shortest golf club and the longest golf club may be inversed. On the other hand, if the weight difference between the steel shafts 3 is exceeds 10 g, then the long golf club becomes excessively light in weight, or the short golf club becomes excessively heavy. Consequently, a good weight balance cannot be obtained for the iron golf club set. A weight of the steel shaft 3 should be set in a range of 90 to 140 g, preferably in a range of 105 to 125 g.

Each golf club has a step formation region R set in a position having a distance equal among the clubs from the grip end in the shaft axial direction. A plurality of steps S are arranged in the step formation region R. A length of the step formation region R in the shaft axial direction and the number of steps S arranged therein are set equal among all the golf clubs. The step formation region R has a first axial distance $G_1$ from its starting end $S_1$ to the grip end set in a range of 65 to 190 mm, and a distance $G_2$ from its terminating end $S_2$ to the grip end set in a range of 601 to 726 mm. By setting the step formation region R based on such starting and terminating ends $S_1$ and $S_2$, a position of a kick point of the golf club can be optimized.

In the step formation region R of each golf club, a specific area Q is set in a position having an equal distance for all of among the clubs from the sole end in the shaft axial direction and is set closer to the grip end than to the sole end with respect to the shaft full length. An interval between the steps in the specific area Q is set narrower than that between the steps outside the specific areas. A length of the specific area Q in the shaft axial direction and the number of steps S arranged therein are set equal among all the golf clubs. In the specific area Q, a distance $L_1$ from its starting end $S_3$ to the sole end is set in a range of 496 to 536 mm, and a second axial distance $L_2$ from its terminating end $S_4$ to the sole end is set in a range of 376 to 416 mm. By setting the specific area Q based on such starting and terminating ends $S_3$ and $S_4$, a position of a kick point of the golf club can be optimized. In other words, by setting the specific area Q at the position separate from the sole end by an equal distance for all of the golf clubs different in length, a kick point can be set nearer to the hand side for the shorter golf club.

An interval P between steps in the specific area Q is set constant, in a range of 20 to 40 mm. Thus, by keeping constant the step interval P in the range of 20 to 40 mm, a kick point can be effectively adjusted. For example, a good result may be obtained by setting a length of the specific area Q in the shaft axial direction in a range of 80 to 160 mm, and the number of steps therein in a range of 2 to 4.

As described above, by varying the weights of the steel shafts 3 among the golf club set and forming the steps S regularly on the surface of the steel shaft 3 of each count, the golf club set can be constructed to have the kick points of the longer golf clubs set at the middle position of the shaft with kick points gradually set nearer to the hand side toward the shorter golf clubs. With such structure, swinging of the golf clubs can be facilitated for the entire club set. Moreover, easy rising of a ball can be realized when it is hit by the longer golf club, and easy control of the direction of a ball can be realized when it is hit by the shorter golf club.

Figure 2:
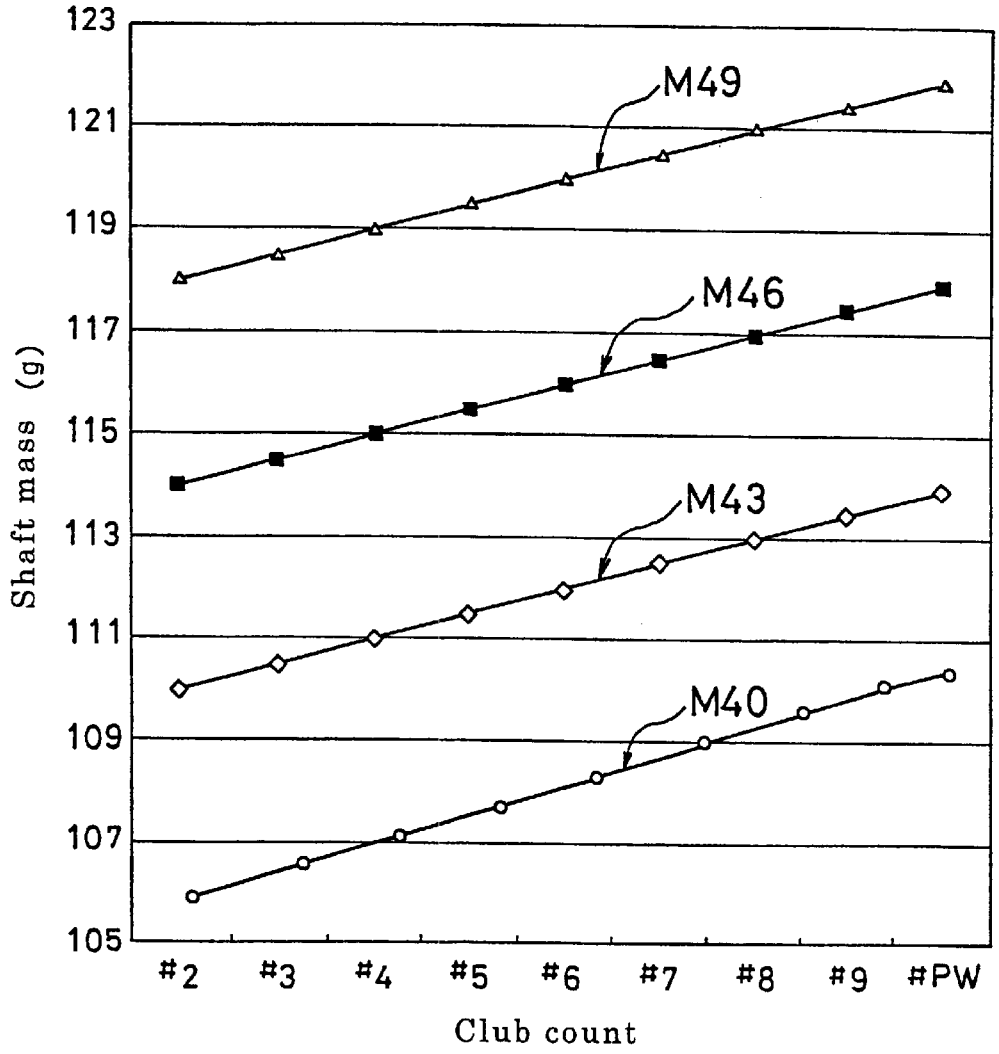
FIG. 2 is a graph showing a relation between a club count and shaft mass of the iron golf club set of the present invention.

FIG. 2 is a graph showing a relation between a club count and shaft mass in each of four kinds of iron golf club sets categorized for different head speeds according to the present invention. In FIG. 2, M40 denotes a set suited for a golfer having a head speed of 40m/sec.; M43, a set suitable for a golfer having a head speed of 43m/sec.; M46, a set suitable for a golfer having a head speed of 46m/sec.; and M49, a set suitable for a golfer having a head speed of 49m/sec.

As shown in FIG. 2, according to the present invention, the shaft weights of the iron golf club set should be increased relatively from the long golf clubs (#2 to #4) to the short golf clubs (#8, #9 and PW).

EXAMPLE

With regard to the iron golf club set including a plurality of golf clubs (#2 to #9 and PW), each golf club having a steel shaft with its outer diameter adjusted based on a step pattern, a head fixed in the tip end portion of the steel shaft and a grip provided in its rear end portion, the inventors manufactured invention sets 1 to 8 according to the present invention, a comparison set and a conventional set, respectively, which have different step patterns as described below. It should be noted that lengths of the golf clubs (#2 to #9 and PW) were #2=991 mm; #3=978 mm; #4=965 mm; #5=953 mm; #6=940 mm; #7=927 mm; #8=914 mm; #9=902 mm and PW=889 mm.

Invention Set 1:

Referring to FIG. 1, distances $G_1$ and $G_2$ for defining the step formation region R of each golf club were respectively 140 mm and 676 mm, distances $L_1$ and $L_2$ for defining the specific area Q were respectively 516 mm and 396 mm, and a step interval P in the specific area Q was 30 mm narrower than that outside the specific area. Weights of the steel shafts were gradually increased from the longest golf club (114 g) to the shortest golf club (118 g). As a result, it was found that a kick point of the longest golf club was set in a middle position of the shaft (middle kick point), while a kick point of the shortest golf club was set nearer to the hand side (high kick point).

Invention Set 2:

In FIG. 1, distances $G_1$ and $G_2$ for defining the step formation region R of each golf club were respectively 140 mm and 676 mm, distances $L_1$ and $L_2$ for defining the specific area Q were respectively 529 mm and 389 mm, and a step interval P in the specific area Q was 35 mm, narrower than that outside the specific area. Weights of the steel shafts were gradually increased from the longest golf club (112 g) to the shortest golf club (116 g). As a result, it was found that a kick pint of the longest golf club was set in a middle position of the shaft (middle kick point), while a kick point of the shortest golf club was set nearer to the hand side (high kick point).

Invention Set 3:

In FIG. 1, distances $G_1$ and $G_2$ for defining the step formation region R of each golf club were respectively 165 mm and 701 mm, distances $L_1$ and $L_2$ for defining the specific area Q were respectively 516 mm and 396 mm, and a step interval P in the specific area Q was 30 mm, narrower than that outside the specific area. Weights of the steel shafts were gradually increased from the longest golf club (114 g) to the shortest golf club (118 g). As a result, it was found that a kick point of the longest golf club was set in a middle position of the shaft (middle kick point), while a kick point of the shortest golf club was set nearer to the hand side (high kick point).

Invention Set 4:

In FIG. 1, distances $G_1$ and $G_2$ for defining the step formation region R of each golf.club were respectively 115 mm and 651 mm, distances $L_1$ and $L_2$ for defining the specific area Q were respectively 529 mm and 389 mm, and a step interval P in the specific area Q was 35 mm, narrower than that outside the specific area. Weights of the steel shafts were gradually increased from the longest golf club (114 g) to the shortest golf club (118 g). As a result, it was found that a kick point of the longest golf club was set in a middle position of the shaft (middle kick point), while a kick point of the shortest golf club was set nearer to the hand side (high kick point).

Invention Set 5:

In FIG. 1, distances $G_1$ and $G_2$ for defining the step formation region R of each golf club were respectively 140 mm and 676 mm, distances $L_1$ and $L_2$ for defining the specific area Q were respectively 516 mm and 396 mm, and a step interval P in the specific area Q was 30 mm, narrower than that outside the specific area. Weights of the steel shafts were gradually increased from the longest golf club (114 g) to the shortest golf club (116 g). As a result, it was found that a kick point of the longest golf club was set in a middle position of the shaft (middle kick point), while a kick point of the shortest golf club was set nearer to the hand side (high kick point).

Invention Set 6:

In FIG. 1, distances $G_1$ and $G_2$ for defining the step formation region R of each golf club were respectively 140 mm and 676 mm, distances $L_1$ and $L_2$ for defining the specific area Q were respectively 516 mm and 396 mm, and a step interval P in the specific area Q was 30 mm, narrower than that outside the specific area. Weights of the steel shafts were gradually increased from the longest golf club (112 g) to the shortest golf club (122 g). As a result, it was found that a kick point of the longest golf club was set in a middle position of the shaft (middle kick point), while a kick point of the shortest golf club was set nearer to the hand side (high kick point).

Invention Set 7:

In FIG. 1, distances $G_1$ and $G_2$ for defining the step formation region R of each golf club were respectively 140 mm and 676 mm, distances $L_1$ and $L_2$ for defining the specific area Q were respectively 496 mm and 416 mm, and a step interval P in the specific area Q was 20 mm, narrower than that outside the specific area. Weights of the steel shafts were gradually increased from the longest golf club (114 g) to the shortest golf club (118 g). As a result, it was found that a kick point of the longest golf club was set in a middle position of the shaft (middle kick point), while a kick point of the shortest golf club was set nearer to the hand side (high kick point).

Invention Set 8:

In FIG. 1, distances $G_1$ and $G_2$ for defining the step formation region R of each golf club were respectively 140 mm and 676 mm, distances $L_1$ and $L_2$ for defining the specific area Q were respectively 536 mm and 376 mm, and a step interval P in the specific area Q was 40 mm, narrower than that outside the specific area. Weights of the steel shafts were gradually increased from the longest golf club (114 g) to the shortest golf club (118 g). As a result, it was found that a kick point of the longest golf club was set in a middle position of the shaft (middle kick point), while a kick point of the shortest golf club was set nearer to the hand side (high kick point).

Comparison Set:

In FIG. 1, distances $G_1$ and $G_2$ for defining the step formation region R of each golf club were respectively 140 mm and 676 mm, distances $L_1$ and $L_2$ for defining the specific area Q were respectively 516 mm and 396 mm, and a step interval P in the specific area Q was 30 mm, narrower than that outside the specific area. Weights of the steel shafts were gradually reduced from the longest golf club (118 g) to the shortest golf club (114 g). As a result, it was found that a kick point of the longest golf club was set in a middle position of the shaft (middle kick point), while a kick point of the shortest golf club was set nearer to the hand side (high kick point).

Conventional Set:

In FIG. 1, distances $G_1$ and $G_2$ for defining the step formation region R of each golf club were respectively 210 mm and 731 mm, and a plurality of steps S were provided at equal intervals in this step formation region R. Weights of the steel shafts were gradually reduced from the longest golf club (116 g) to the shortest golf club (114 g). As a result, kick points of all the golf clubs were set at the hand side.

A kick point of each golf club can be determined by a conventionally known method. For example, either the tip end (head side) or the butt end (grip side) of the steel shaft is fixed by a clamp, the shaft is distorted by applying a specified weight to the other end, and a kick point is obtained from a difference between a distortion quantity at the time of tip fixing and a distortion quantity at the time of butt fixing. Then, based on the obtained kick point, it is decided which kick point including low, middle and high kick points each golf club has.

For the foregoing invention sets 1 to 8, the comparison set and the conventional set, the inventors evaluated easiness of swinging and stability of a hit ball direction by the following measuring method. The result of the evaluation is shown in Table 1. In a column of Table 1 showing the kick point of the golf club, M denotes the middle kick point and H denotes the high kick point.

Easiness of Swinging:

Ten testers took part in trial hitting, and easiness of swinging for the entire set was evaluated on a maximum of 5 points. A result of evaluation indicates an average value among evaluation points for all the testers. A larger numerical value means easier swinging.

Stability of Hit Ball Direction:

Ten testers took part in trial hitting, and a ratio (%) of variance to flying distance was obtained by measuring variance (m) of arrival points with respect to a target and flying distances (m). A result of evaluation indicates an average value among measured values for all the testers. A smaller numerical value means better stability of a hit ball direction.

TABLE 1

| | Invention set 1 | Invention set 2 | Invention set 3 | Invention set 4 | Invention set 5 | Invention set 6 | Invention set 7 | Invention set 8 | Comparison set | Conventional set |
|---|---|---|---|---|---|---|---|---|---|---|
| G1 (mm) | 140 | 140 | 165 | 115 | 140 | 140 | 140 | 140 | 140 | 210 |
| G2 (mm) | 676 | 676 | 701 | 651 | 676 | 676 | 676 | 676 | 676 | 731 |
| L1 (mm) | 516 | 529 | 516 | 529 | 516 | 516 | 496 | 536 | 516 | — |
| L2 (mm) | 396 | 389 | 396 | 389 | 396 | 396 | 416 | 376 | 396 | — |
| P (mm) | 30 | 35 | 30 | 35 | 30 | 30 | 20 | 40 | 30 | — |
| Kick point of golf club | M → H | M → H | M → H | M → H | M → H | M → H | M → H | M → H | M → H | H → H |
| Weight of shaft (g) | 114 → 118 | 112 → 116 | 114 → 118 | 114 → 118 | 114 → 116 | 112 → 122 | 114 → 118 | 114 → 118 | 118 → 114 | 116 → 114 |
| Easiness of swinging | 4 | 4.2 | 3.8 | 4.3 | 3.8 | 3.6 | 4.0 | 4.0 | 2.5 | 2.4 |
| Stability of ball direction | 3.3 | 4.1 | 3.7 | 4.3 | 4.9 | 4.5 | 4.3 | 4.3 | 7.2 | 6.1 |

As can be understood from Table 1, any of the invention sets 1 to 8 provided easier swinging and had little variance in hit balls compared with the conventional set. On the other hand, in the case of the comparison set, because of the gradual reduction in the weights of the steel shafts from the longer golf club to the shorter golf club, an effect like that obtained by each of the invention sets 1 to 8 was not obtained.

As described above, according to the present invention, since the steel shaft weight and the step pattern of each golf club are specified, the iron golf club set including the plurality of golf clubs of the present invention are very advantageous in the following respects.

(1) Since the steel shaft of the longer golf club is light and a kick point is set in a middle position of the shaft (middle kick point), swinging can be facilitated for all of the club set, and easier ball rising can be realized.

(2) Since the steel shaft is heavier for the shorter golf club and a kick point is set nearer to the hand side, heaviness is felt at the shorter golf club, and direction control of a hit ball can be facilitated.

(3) It is possible to make an iron golf club set enabling swinging to be performed without any unnatural feelings for the entire club set, and even a general golfer to easily use the clubs.

Although the preferred embodiment of the present invention has been described in detail, it should be understood that various changes, substitutions and alternations can be made therein without departing from spirit and scope of the invention as defined by the appended claims.

What is claimed is:

1. A golf club iron set comprising:

a plurality of golf club irons of different counts and of correspondingly different lengths, each golf club iron having a steel shaft, a grip end, and a head sole end, the steel shaft of a shorter of the plurality of golf club irons being heavier than that of a longer of the plurality of golf club irons;

the steel shaft of each golf club iron having:

a step formation region spaced by a first axial distance from the grip end thereof, the first axial distance being equal for all of the plurality of golf club irons, an outer diameter in the step formation region differing in a plurality of steps; and a specific area of steps within the step formation region and spaced by a second axial distance from the head sole end thereof, the second axial distance being equal for all of the plurality of golf club irons and placing the specific area nearer to the grip end than to the head sole end, an interval between steps in the specific area being smaller than an interval between steps in the step formation region outside of the specific area.

2. The golf club iron set according to claim 1, wherein weights of the steel shafts are gradually increased from the longest golf club to the shortest golf club in the set.

3. The golf club iron set according to one of claim 1 or 2, wherein a weight difference between a steel shaft of the longest golf club and that of the shortest golf club in the club set is set in a range of 2 to 10 g.

4. The golf club iron set according to one of claim 1 or 2, wherein a starting end of the step formation region is in a range of 65 to 190 mm from the grip end and a terminating end thereof is in a range of 601 to 726 mm from the grip end, and wherein a starting end of the specific area is in a range of 496 to 536 mm from the sole end and a terminating end thereof is set in a range of 376 to 416 mm from the sole end.

5. The golf club iron set according to one of claim 1 or 2, wherein a step interval in the specific area is consistant.

6. The golf club iron set according to one of claim 1 or 2, wherein a step interval in the specific area is in a range of 20 to 40 mm.

7. The golf club iron set according to one of claim 1 or 2, wherein the specific area has an axial length in a range of 80 to 160 mm, and the number of steps in the specific area is in a range of 2 to 4.

* * * * *